US008669501B2

(12) United States Patent
Frommer

(10) Patent No.: US 8,669,501 B2
(45) Date of Patent: Mar. 11, 2014

(54) CONTROL SYSTEM FOR COOKING APPLIANCE DURING JEWISH HOLIDAYS AND SABBATH

(76) Inventor: Myron H. Frommer, Monsey, NY (US)

( * ) Notice: Subject to any disclaimer, the term of this patent is extended or adjusted under 35 U.S.C. 154(b) by 56 days.

(21) Appl. No.: 13/343,390

(22) Filed: Jan. 4, 2012

(65) Prior Publication Data

US 2012/0181266 A1 Jul. 19, 2012

Related U.S. Application Data

(60) Provisional application No. 61/461,292, filed on Jan. 18, 2011.

(51) Int. Cl.
*H05B 1/02* (2006.01)

(52) U.S. Cl.
USPC ..... 219/492; 219/412; 219/494

(58) Field of Classification Search
CPC ..... H05B 1/02
USPC ..... 219/492, 494, 497, 412–414
See application file for complete search history.

(56) References Cited

U.S. PATENT DOCUMENTS

| | | | | |
|---|---|---|---|---|
| 3,837,568 | A * | 9/1974 | Goodhouse et al. | 235/61 A |
| 4,198,576 | A * | 4/1980 | Staton | 307/141.8 |
| 4,521,869 | A | 6/1985 | Moss et al. | |
| 4,756,336 | A | 7/1988 | Amezcua | |
| 5,069,091 | A | 12/1991 | Bramsiepe | |
| 5,693,245 | A | 12/1997 | Clizbe | |
| 5,808,278 | A | 9/1998 | Moon | |
| 5,841,112 | A | 11/1998 | Brooks | |
| 5,942,816 | A | 8/1999 | Carter | |
| 6,066,837 | A | 5/2000 | McCormick et al. | |
| 6,153,858 | A * | 11/2000 | Barnes et al. | 219/413 |
| 6,473,661 | B1 | 10/2002 | Wollner | |
| 6,660,982 | B2 | 12/2003 | Thorneywork | |
| 6,703,591 | B2 | 3/2004 | Daum et al. | |
| 7,002,109 | B2 | 2/2006 | Klask | |
| 7,069,091 | B2 | 6/2006 | Williamson | |
| 7,640,930 | B2 * | 1/2010 | Little et al. | 126/214 R |
| 8,067,706 | B2 * | 11/2011 | Tukachinsky | 200/19.15 |
| 2003/0080113 | A1 | 5/2003 | Williamson | |
| 2005/0133353 | A1 | 6/2005 | Whitman | |
| 2008/0011736 | A1 * | 1/2008 | Lenhart et al. | 219/412 |

* cited by examiner

*Primary Examiner* — Mark Paschall
(74) *Attorney, Agent, or Firm* — Michael E. Zall

(57) ABSTRACT

A cooking appliance control system for use during the Jewish Holidays or Sabbath. A timer is in communication with the oven heater element programmed to provide for scheduled activations and deactivations of the element during the Holidays. Prior to the Holiday the timer is programmed, the oven is activated to the predetermined temperature, and the timer program is then activated to provide for activation of the heater element to the predetermined temperature and deactivation in accordance with the schedule during the Holiday. Additionally, a switch selectively activates and deactivates the ignition circuits of the burners. This permits, one of the gas burner heater elements to be lighted by the appliance before the Holiday when the ignition circuits are activated to provide a flame to light the other burners when the ignition circuits are deactivated during the Holiday.

12 Claims, 4 Drawing Sheets

CONTROL SYSTEM FOR COOKING APPLIANCE DURING JEWISH HOLIDAYS AND SABBATH

RELATED APPLICATIONS

This application claims the benefit of Provisional Application No. 61/461,292 filed on Jan. 18, 2011.

FIELD OF THE INVENTION

This invention relates to a control system for a cooking appliance, such as an oven, cooktop stove, warming drawer, heating unit, that includes an electrical, electro-mechanical, electronic or digital, timed switching device (timer) that permits various functions of the cooking appliance to be automatically controlled for use on a Jewish Holiday (Yom Tov) or Sabbath (Shabbos, Shabbat), in compliance with Orthodox. Jewish Laws which prohibit 'creative work' to be performed on such Holidays. The system can control a plurality of cooking appliance elements, for example, the stove top gas, electric or radiant burners, the oven gas igniter or electric heater and the warming drawer and provide independent control of each. The control systems may be incorporated, internally or externally, during the initial production of the cooking appliance or purchased as an external, after-market, retrofitted system. The control system may, for example, be used alone or in conjunction with factory-installed Sabbath Mode digital systems.

BACKGROUND OF THE INVENTION

It is the practice of Orthodox Jews that no 'creative work' can be done, for example, on the Sabbath or Jewish Holidays. For convenience, the Sabbath and Jewish Holidays will be collectively referred to herein (at times) as the Jewish Holidays. The Orthodox Jewish laws forbid work to be done on the Sabbath, such as using a household cooking appliance, and constrains the Orthodox. Jew from causing the cooking appliance to change its normal pattern of operation during the Sabbath, e.g., an action by the user that illuminates or changes a display, activates an audible display, turns on a light, ignites a flame or heats an element. Disconcertingly, many new household cooking appliances have control systems with a variety of visual and audible indicators and aids, such as interior lights, that make it difficult, if not impossible, for Orthodox Jews to operate the cooking appliance in compliance with the restrictions in place during the Jewish Holidays. For example, most refrigerators and ovens have an interior light that is activated by the user of the cooking appliance by opening the door. Under the Orthodox Jewish law, if the interior light remained constantly on or off during the Jewish Holiday it would comply with the law and it was not activated by the opening or closing of the door. This has resulted in the practice by Orthodox Jews of unscrewing or removing the interior lights of the cooking appliance, deactivating light switches, or turning the light on prior to the Jewish Holiday and leaving the light on continuously for its duration.

Another example, with respect to ovens, is that they must be turned on and off to cook. A generally recognized solution is to turn the oven OFF prior to the commencement of the Sabbath (for maintaining food hot with the oven's residual heat, since no cooking may be done) or ON before the commencement of the Holiday and leaving it on until after the termination of the Holiday (or Holiday/Sabbath combination). Alternatively, the oven could be left off during the Sabbath and no warm food would be available. Obviously, these solutions are very inconvenient and are a disadvantage of the current cooking appliances, and some older models.

A "Sabbath Mode (English) control system—(also known as Shabbos Mode (Yiddish) or Shabbat Mode (Hebrew))—is a feature in many modern home cooking appliances, including, but not limited to, ovens, refrigerators and air conditioners. Such a system is intended to allow the cooking appliance to be used (subject to various constraints) by the Sabbath-observant Jews on the Sabbath and on the Jewish Holidays. The Orthodox Jewish laws are restrictive and complicated. While raw food may not be cooked on the Sabbath, food that has been cooked before the Sabbath may be kept warm until mealtime (under certain conditions). On some Jewish Holidays, or on Jewish Holidays directly preceding the Sabbath, the food may be freshly cooked during such Holiday. However, turning the heat on during such a Holiday is prohibited. Transferring a flame from one which was lit before the commencement of the Holiday is permitted. When the Sabbath and a Jewish Holiday coincide, the more restrictive Sabbath regulations prevail.

In the past, the problems associated with these laws could be solved by merely lighting a stove or oven before the Jewish Holiday began, and using the heat over the course of the day or days. However, in recent years cooking appliance manufacturers, e.g., ovens, toaster ovens, have instituted a safety feature that automatically shuts off the heating element, whether it is gas or electric, after a number of hours. This renders this technique useless for those who observe the Orthodox Jewish Laws, because the oven will not stay lit for the required length of time.

When a cooking appliance, such as an oven, has a (built-in) Sabbath Mode control system, the standard six- or twelve-hour automatic shutoff is overridden, and all lights and displays (for example, a light that might go on when the door is opened) are disabled. In more recently designed ovens, the "Sabbath Mode" control system will often feature the ability to adjust the temperature of the oven during the Jewish Holiday without any observable feedback of this change to the operator of the oven. This is not particularly relevant to the Sabbath in that the temperature may not be changed at all, but such temperature adjustments may be useful on Jewish Holidays, wherein according to prevailing Orthodox opinion, adjusting the heat is permitted (under certain conditions), but changing a digital readout on the control panel is not.

To resolve this issue, in some "Sabbath Mode" ovens that are controlled using a keypad to set the temperature, there is a pseudo-random delay triggered after a button is pressed but before the temperature change takes place. There are those who are of the opinion that touching the keypad and closing a switch to complete a circuit is not allowed. To overcome this objection, there is, for example, a Tweaker, see Torah Technologies (http://torahtechnologies.org) that emulates old manual ovens by adding a knob that 'confuses' the accurate temperature measurement in a beneficial fashion.

Contemporary electronic ovens currently being sold are no longer simply ovens that cook, but rather sophisticated, computer driven electronic devices. While in the past, the Jewish religious laws pertaining to using ovens on the Sabbath and Jewish Holidays were fairly straightforward, nowadays simply opening and closing the ovens can entail violations of Sabbath and Jewish Holiday laws. The Sabbath Mode on many of the ovens sold today resolves many of these issues, and is useful. However, in June 2008, a number of prominent Jewish legal rabbinical authorities (poskim) signed a public pronouncement stating that it was unequivocally forbidden to raise or lower, the temperature by reprogramming on a Jewish Holiday (Yom Tov) using the Star-K Kosher Certification organization's (Baltimore, Md.) approved Sabbath Mode feature. Doing so on the Sabbath has never been permitted.

More particularly, the development of a Sabbath Mode operation for ovens has as a goal of permitting the raising and lowering of oven temperatures on the Jewish Holidays (but not on the Sabbath). The change in temperature settings is accomplished by pressing keys on a keypad that is connected to the microcontroller built into the oven. Pressing the keys while in Sabbath Mode does not result in an immediate change in oven temperature nor does it have any other observable effect. Allowing this activity is based on the presumption that pressing the keys is merely a gramma and is therefore permitted on the Jewish Holiday.

An indirect action is called gramma, from the Hebrew root meaning 'to cause' something to happen. Two conditions (which are based on the same principle) are necessary for the action to be considered gramma:

(1) At the moment, that the gramma action is performed, no simultaneous action should take place, and no sequential chain of action should be started. The initiating action must be insignificant from the point of view of the Sabbath. For example, turning on a delay timer that will cause a specific action after a preset time is not gramma. It is like shooting an arrow, which is considered a direct action even if the result takes place far away and after a delay. Placing a jug of water in the path of a flame to extinguish it or changing the setting of a Shabbat timer, under limited conditions, on the other hand, do not cause any immediate effect.

(2) An independent factor, which was prepared before Shabbat or is created automatically, will take effect latter on and be influenced by the action that was performed by the person. Only then will the desired effect take place. In the previous examples, the flame will reach the water later on, just as the timer switch will be activated after an indeterminate delay.

However, as mentioned above, it has recently been decided by a very significant segment of rabbinical authorities, that pressing the keys on the Jewish Holiday is strictly forbidden since pressing a key immediately closes an electrical circuit and instructs the microcontroller to carry out an action. Pressing the key is forbidden just as all manipulation of electricity is forbidden on Shabbos and Jewish Holidays. There can be a Torah law violation immediately upon pressing the key even if no 'fire' is created. This operation is not considered gramma.

Thus it was decided that the use of the Sabbath Mode on an oven to change the temperature of an oven on the Jewish Holiday represents an assault on the sanctity of such Holiday. For example, opening the oven door may immediately turn on the heating elements because of a detected decrease in temperature, an act clearly forbidden on the Jewish Holiday.

Thus, there is a need for cooking devices to have a means for avoiding such religious violations. The existing control systems do not allow the cooking appliance to start after the Jewish Holiday (Yom Tov) commences, except for possibly the use of a usual 'delayed start' within 12 or 24 hours from initial setting, nor start or restart on the second day of the Jewish Holiday, or the Jewish Holiday if it follows the Sabbath, or turn off for the Sabbath if it follows a Jewish Holiday. Additionally, existing control systems for the Jewish Holidays or Sabbath are generally not designed as an after-market retrofit to an existing cooking appliance. Still further, existing control systems are not adapted for use in non-computer controlled or digitally controlled cooking appliances such as, warming drawers, cooktop burners or heating elements.

Possibly relevant references are:

U.S. Pat. No. 7,069,091 to Williamson describes a microwave oven with a controller that stores recipe programs and operates the generator in accordance with the recipe program.

U.S. Pat. No. 7,002,109 to Klask describes an automatic stove timer and alarm apparatus and method of use with an electrical circuit that provides a timer that is enabled for continuous repetitive fixed timing cycles.

U.S. Pat. No. 6,703,591 to Daum et al. describes a control system that: has a large market share of Shabbos/Yom Tov compliant ovens. The appliance is operable in a normal mode and a Jewish Holiday mode. The appliance includes an electronic control system and a control interface panel for user selection of appliance features. The control interface panel includes a plurality of input keys and at least one display including a plurality of indicators for indicating appliance features and settings. The system provides for delaying a display of at least one of the indicators for a randomly determined time period.

U.S. Pat. No. 6,660,982 to Thorneywork, et al., describes a programmable cooking system that includes several cooking devices, e.g., microwave or regular ovens. It is directed to the catering industry delivering a given range of meals with maximum speed and efficiency. The programming includes instructions for specific items and a specific oven to preclude the operator from having to manually program cooking sequences for each item into its oven, e.g. defrost, microwave cook and conventionally brown. The operator can specify the oven and cooking sequence with the push of a button.

U.S. Pat. No. 6,473,661 to Wollner describes a home automation system for automatically controlling the electric lights and appliances in a Jewish family's home or Jewish institution. The system is, preset to generate regular schedules for Shabbos and Jewish Holidays based on the Jewish calendar and may also generate regular weekday scheduled events. Special schedules such as vacation mode, guest mode, summer mode and the like may be added and adjusted by the user as well. The special schedules or modes may be manually activated by a mechanical device outside the computer. Updated schedules are reported to a remotely located monitoring system.

U.S. Pat. No. 6,066,837 to McCormick et al. describes a Sabbath compliant cooking apparatus that deactivates functions, tones and indicators on a double (over/under) oven during the Sabbath. The controller also imposes a delayed response to opening and closing of a door.

U.S. Pat. No. 5,942,816 to Carter describes a precautionary timer for a kitchen range surface element.

U.S. Pat. No. 5,808,278 to Moon et al describes an appliance capable of being operated in compliance with the Orthodox Jew requirement that no work shall be done on the Sabbath. The appliance has a control system that monitors and controls all of the components of the appliance. The control system can be activated so that it prevents all visual displays and audible alarms from being actuated by the user during the Sabbath. The control system also prevents any actions of the user from causing the machine to do work.

U.S. Pat. No. 5,841,112 to Brooks et al describes a service diagnostic system for an electronic cooking appliance.

U.S. Pat. No. 5,693,245 to Clizbe describes an electric range surface burner controller that when the selected amount of time expires, e.g., 0-60 minutes, the burner is shutoff. No delayed start is taught or suggested.

U.S. Pat. No. 4,756,336 to Amezcua describes an electromechanical device that converts an ordinary manually operated stove to a timer controlled stove.

U.S. Pat. No. 4,521,869 to Moss describes a program timer for building heating, air conditioning, water pumps, etc.

US Patent Publication No. 2003/0080113 and U.S. Pat. No. 5,069,091 to Williamson describes an oven having a controller that stores a plurality of recipes and operates the heat generator in accordance with a recipe program.

US Patent Publication No. 2005/0133353 to Whitman describes a Sabbath Switch Cover to selectively disable or enable the internal lighting system of a kitchen appliance.

OBJECTS AND SUMMARY OF INVENTION

This invention eliminates the disadvantages and inconveniences of the current cooking appliances and their control systems by providing a method and a control system that can be used to operate a plurality of elements of the cooking appliance, typically the oven heating elements or the top gas burners, during the Sabbath and/or Jewish Holidays in accordance with the Orthodox Jewish laws.

This invention, in one embodiment, provides a retrofit-type control system for selectively operating one or more heating elements of a cooking appliance during the Sabbath and/or Jewish Holidays in accordance with the Orthodox Jewish laws. Optionally, the control system may be included in the oven by the original manufacturer.

Broadly, one embodiment of this invention is directed to a method and control system for selectively activating and deactivating a heater element of a cooking appliance a plurality of times during at least one Jewish Holiday period of time in compliance with the Orthodox Jewish laws. When activated during the holiday, the heater element reaches a predetermined level set before the Jewish Holiday.

The method includes providing a programmable timer in communication with the heater element of the cooking appliance. The timer is programmed to provide for a plurality of activations and a plurality of deactivations of the heater element in accordance with a predetermined schedule during a predetermined period of time that is longer than the at least one Jewish Holiday period of time. When the timer initially activates, the heater element activates to a predetermined level determined by the cooking appliance. When the timer subsequently activates and deactivates the heater element respectively activates to the predetermined level and deactivates in accordance with the predetermined schedule for activations and deactivations of the heater element.

Prior to the Jewish Holiday period of time, the timer is programmed to provide for the schedule of activations and deactivations of the heater element during the Jewish Holiday. The timer is then activated to activate the heater element to the predetermined level by the cooking appliance. Subsequently, during the Jewish Holiday period, the heater element activates to the predetermined level and deactivates a plurality of times.

Another aspect of this invention is directed to a method and control system for selectively lighting a plurality of gas burner heater elements of a cooking appliance during at least one Jewish Holiday period of time in compliance with the Orthodox Jewish Laws. Each gas burner heater element has an ignition circuit to light the heater element.

The method includes a switch that is in communication with each, or all, ignition circuit(s) of the of heater elements. The switch selectively activates or deactivates each or all, ignition circuit(s). Thus, prior to the Jewish Holiday period of time, the ignition circuits for the heater elements are activated by the switch and at least one gas burner heater element may be lighted to a predetermined level determined by the cooking appliance. This produces a continuous flame from this burner. Subsequently, the switch selectively deactivates each of the ignition circuits of the heater elements. The at least one lighted burner continues to produce a continuous flame. Subsequently during the Jewish Holiday another gas burner heater element may be lighted to a predetermined level determined by the cooking appliance by manually lighting the gas burner heater element from the flame of the gas burner that has already been lighted prior to the Jewish Holiday period.

Both of these methods and control systems may be used either alone or in conjunction with each other to provide a cooking appliance, e.g., stove or oven, wherein all of the heater elements and burners may be operated during at least one Jewish Holiday period of time, including the Sabbath, in compliance with the Orthodox Jewish Laws

BRIEF DESCRIPTION OF THE DRAWINGS

Further aspects, features and advantages of the present invention will become even more apparent with reference to the following detailed description and the accompanying drawings.

Figure 1:
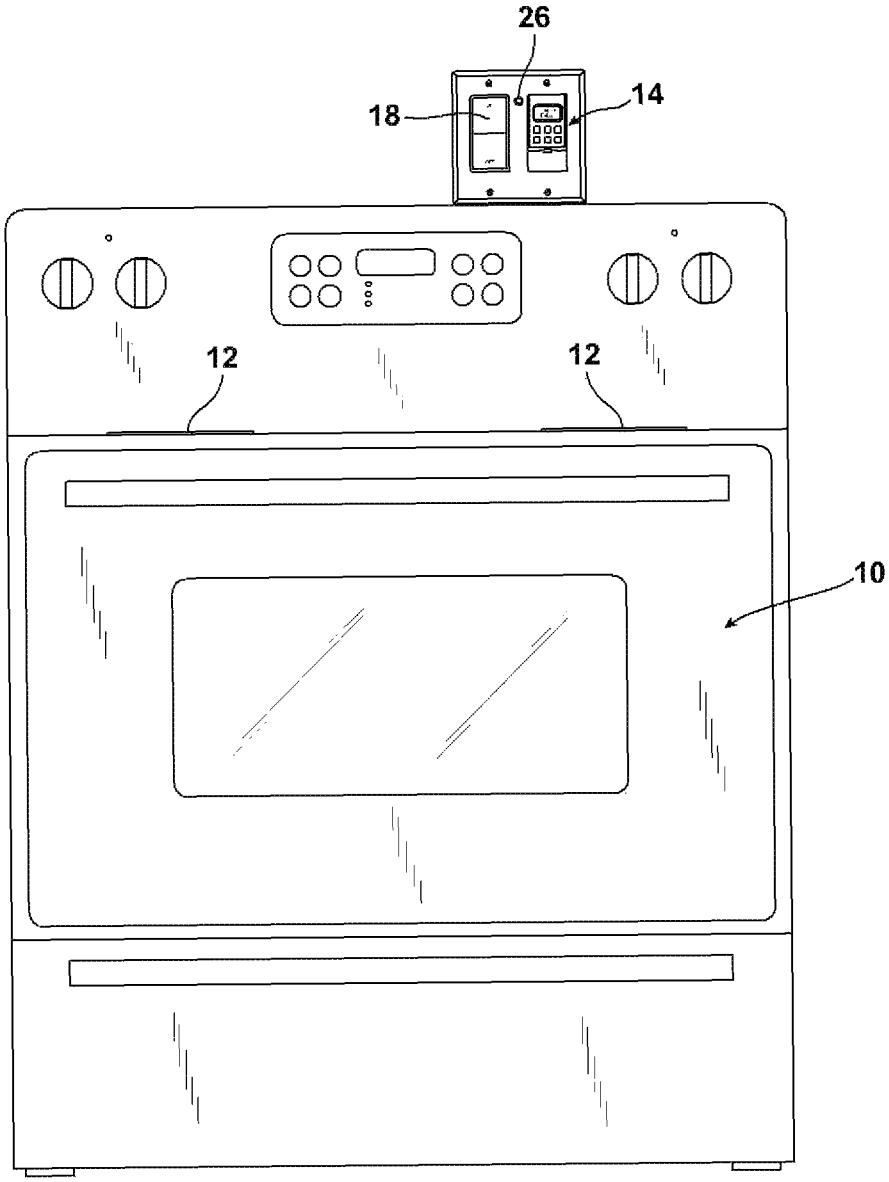
FIG. 1 is a front view of an oven 10 retrofitted with the control systems, of this invention.
Figure 2:
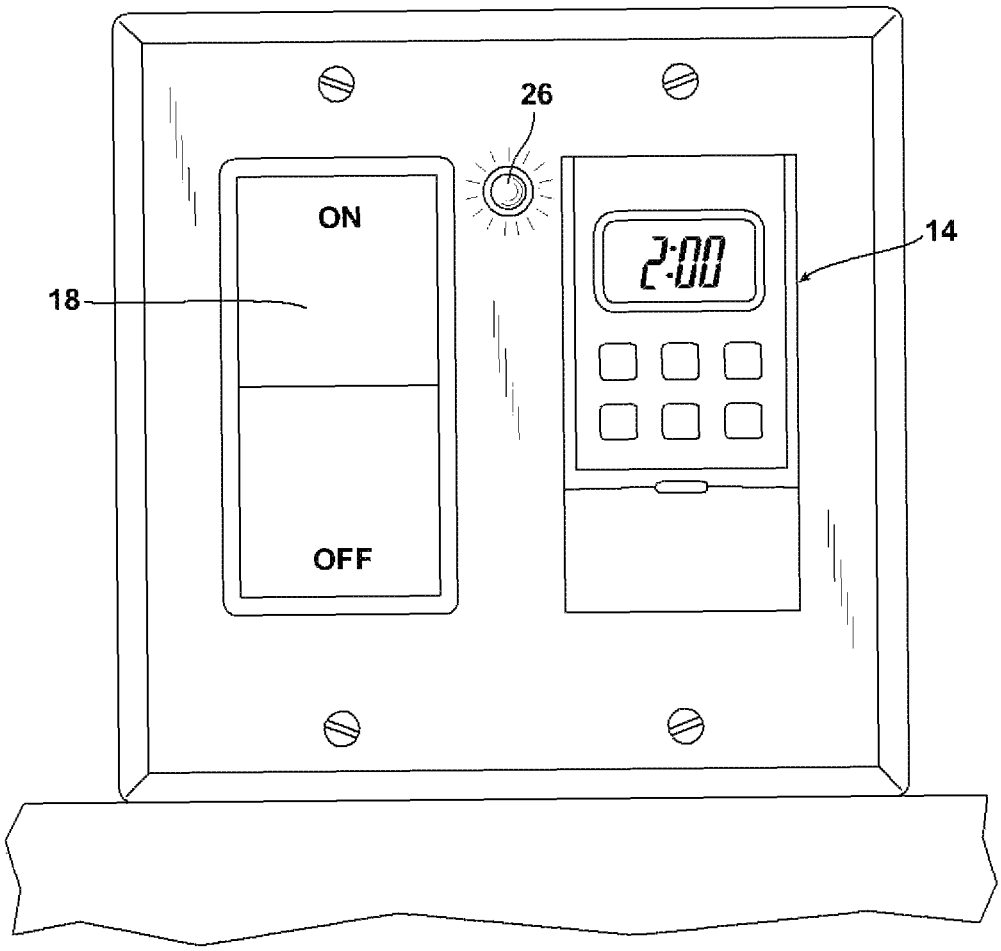
FIG. 2 is front view of the programmable timer 14 and switch 18 used in the control systems of this invention.
Figure 3:
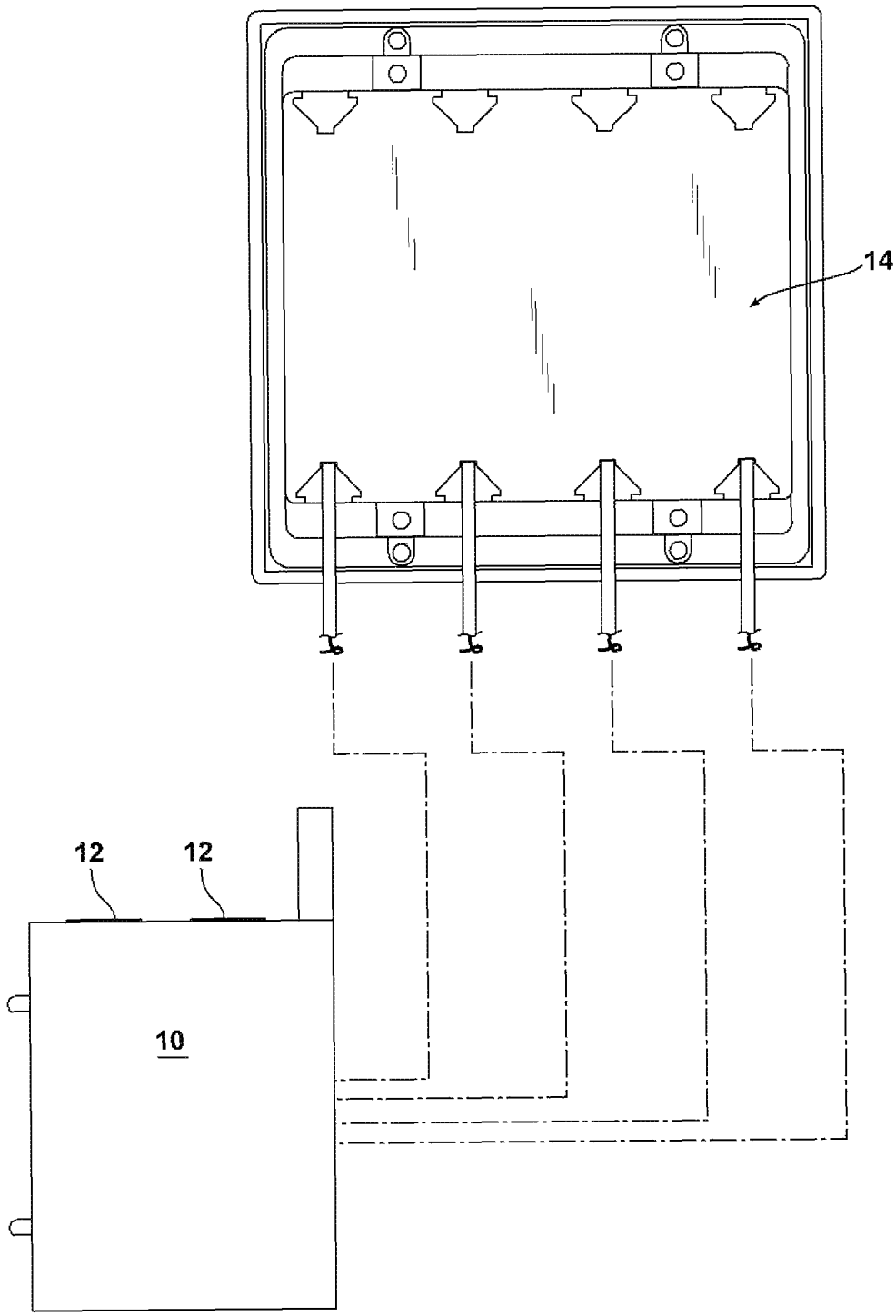
FIG. 3 a schematic drawing showing the wiring of the programmable timer 14 and switch 18 to the oven 10 and burners 12 used in the control systems of this invention.

The Figures are only representative of certain aspects of the invention with emphasis being placed upon illustrating the principles of the invention.

DETAILED DESCRIPTION OF THE INVENTION

FIGS. 1-4 depict embodiments of this invention in use in a cooking appliance, in particular a gas oven 10. It should be kept in mind that the control systems of this invention may be used in many types of cooking appliances, particularly those for preparing foods during the Jewish. Holidays, e.g., toaster ovens, warmer draws, etc., including electric ovens and stoves.

Referring to FIGS. 1-4, one aspect of this invention is directed to a method and control system for selectively activating and deactivating a heater element 12, 16 of a cooking appliance 10 a plurality of times during at least one Jewish Holiday period of time in compliance with the Orthodox Jewish Laws. This may be, for example the Sabbath (one day) or a Sabbath followed by a Jewish Holiday or one or more Jewish Holidays. For convenience herein, collectively, these are termed Jewish Holidays.

When activated during the Jewish Holiday, the heater element 12, 16 reaches a predetermined level set before the Holiday. The heater element may, for example, be a stove top burner 12 or the oven heater element 16, e.g., the gas or electric heater, in the oven 10.

Still referring to FIGS. 1-4, the method includes providing a programmable timer 14 in communication with the heater element 16 of the cooking appliance 10. The timer 14 is programmed to provide for a plurality of activations and a plurality of deactivations of the heater element 16 in accordance with a predetermined schedule during a predetermined period of time that is longer than the at least one Jewish Holiday period of time. When the timer 14 initially activates, the heater element 16 activates to a predetermined level determined by the cooking appliance 10. When the timer subsequently activates and deactivates the heater element 16, it respectively activates to the predetermined level and deactivates in accordance with the predetermined schedule for activations and deactivations of the heater element 16.

In a preferred embodiment, the heater element is the oven 10 gas burner 16, but may be an electric heater element. Alternatively, the heater element may be a stove top electric burner 12 or an electric heating surface on the top of the stove, see FIG. 1 or a warmer (not shown). The heating element or elements 16, 12 are each activated to a predetermined level. This predetermined level is typically the temperature that is set by the oven 10 when in normal use, either be selecting the temperature digitally or by turning a knob that controls the flow of gas to a gas burner or the flow of electricity to an electric heater. The predetermined level, e.g. temperature, in an oven is typically controlled or maintained by its thermostat.

The timer 14 activates and deactivates the heater 16 a plurality of times during at least one Jewish Holiday period in compliance with the Orthodox Jewish Laws. The Jewish Holiday period can be a single day, e.g., the Sabbath, or can be a series of Jewish Holidays that cover several days, e.g., the Sabbath followed by a Jewish Holiday.

A programmable timer 14 is provided that is in communication with the heater element 16 of the cooking appliance 10. The timer 14 is programmed to provide for a plurality of activations and a plurality of deactivations of the heater element 16 in accordance with a predetermined schedule during a predetermined period of time that is longer than the at least one Jewish Holiday period of time. When the timer 14 initially activates, the heater element 16 activates to a predetermined level, e.g., temperature, determined by the cooking appliance 10. When the timer 14 subsequently activates and deactivates the heater element 16, the heater element 16 respectively activates to the predetermined level and deactivates in accordance with the predetermined schedule for activations and deactivations.

To set or initialize the oven 10 heating element 16 levels, i.e., temperature, the manual or computer operated temperature controls of the oven 10 and/or heating unit 16 are set by the operator as normally done and the oven 10 is turned on, allowing the oven 10 to reach its planned, desired temperature. It is not required to have the oven 10 in operation immediately after initialization. After this is accomplished, the timer 14 deactivates turning the oven 10 off but maintaining the temperature setting and digital display, if so provided. The oven 10 will not reach the set temperature again until the next programmed ON period is reached by the timer 14. The heating element 12 then activates to the predetermined level, e.g., temperature, and deactivates a plurality of times during Jewish Holiday period in accordance with the programmed schedule.

The ON/OFF periods, comprising days and times, for desired operation of the heating element(s) 12, 16 are set or entered into the timing device(s) 14 before the Sabbath or Jewish Holiday commences. For example, if one desires to cook food during a Jewish Holiday for lunch at 12 noon for 75 minutes and dinner at 6 PM for 90 minutes, the timer 14 is programmed before the Jewish Holiday to turn the oven 10 heating element 12, 16 off before the Jewish Holiday, to go on during the Jewish Holiday at 12 noon, off at 1:15 PM, go on at 6 PM and off at 7:30 PM.

Figure 4:
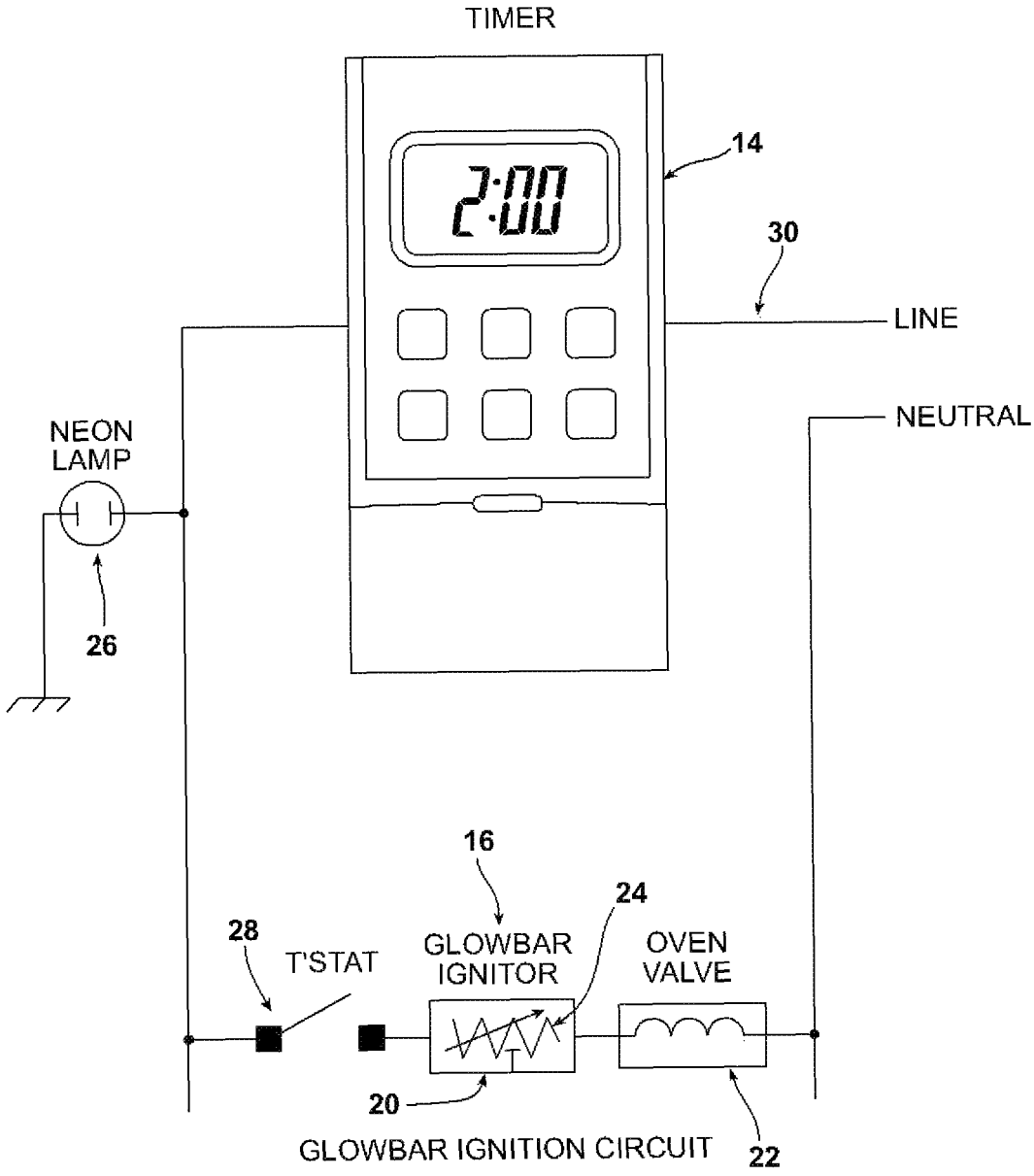
FIG. 4 is a schematic wiring diagram showing the timer 14 used in this invention installed in an oven 10.

The programmable timer 14 may be all electrical, electromechanical, electronic, or digital timed, switching device. As depicted in FIG. 4, the timer 14 is wired in series with the electronic/electrical ignition device for the heater element 16 of a gas-fired or electrically heated oven 10. Generally; as shown and described in detail herein, one programmable timer 14 is required for each heater element 12, 16 i.e., one for the oven, one for a warming drawer, etc. However, a programmable timer 14 may be used which can be programmed to provide for a plurality of activations and a plurality of deactivations of the oven 10 for a plurality of heater elements 12, 16 for a plurality of predetermined temperatures. Thus, each heater element 12, 16 activates to provide for its respective predetermined temperature and deactivates a plurality of times in accordance with the schedule during the Jewish Holiday (s) period.

Preferably, the timer 14 is capable of operating a seven-day program. A 24 hour-programmed tinier 14 may be used, but this would preclude the convenience of a, more varied program covering a sequence of Jewish Holidays.

Prior to the Jewish Holiday period of time the timer 14 is programmed to provide for the schedule of activations and deactivations of the heater element 12, 16 during the Jewish Holiday. The timer 14 is then activated to activate the heater element 12, 16 to the predetermined level by the settings entered into cooking appliance 10. Subsequently during the Jewish Holiday period the heater element activates to the predetermined level and deactivates a plurality of times.

Referring to FIGS. 1 and 4, another aspect of this invention is directed to a method and control system for selectively lighting a plurality of gas burner heater elements 12, preferably on top of the a cooking appliance 10, during at least one Jewish Holiday period of time in compliance with the Orthodox Jewish Laws. Each gas burner heater element 12 has an ignition circuit 30 to light the heater element 12 or 16.

This aspect of the invention is generally suitable for stove top gas burner heater elements 12 that have an exposed flame that can be easily accessed, see FIG. 1. The method includes a switch 18 that is in communication with each or all ignition circuit(s) of the of heater elements 12. The switch 18 selectively activates or deactivates each or all ignition circuit(s). Thus, prior to the Jewish Holiday period of time the ignition circuits for the heater elements 12 are activated by the switch 18 and at least one gas burner heater element 12 may be lighted to a predetermined level determined by the cooking appliance 10. With a gas top burner 12, depicted in FIG. 1, the predetermined level is set by turning a knob (not shown) for the respective burner to set different levels of gas flow. This produces a continuous flame from this burner 12. Optionally, other gas burner heater elements 12 may be set to a predetermined level. Subsequently, the switch 18 selectively deactivates each of the ignition circuits of the heater elements 12. The lighted burner 12 continues to produce a flame after deactivation of all the ignition circuits. Subsequently during the Jewish Holiday another gas burner heater element 12 is lighted to a predetermined level determined by the cooking appliance, e.g., turning the burner knob, by manually lighting such gas burner heater element 12 from the flame of the gas burner that has already been lighted prior to the Jewish Holiday period. If no gas burner heater element 12 is lighted before the onset of the Holiday period, it may be lighted during the Holiday in this manner, i.e., another flame.

When the deactivated mode of switch 18 is selected and maintained, the heating elements 12 operate in a normal, non-Jewish Holiday, non-Sabbath mode. Likewise, when the timer 14 is not in operation the heating element 16 also operates in a normal, non-Jewish Holiday, non Sabbath mode.

In order to accommodate the Orthodox Religious Laws, some built-in oven features may have to be manually disabled by the user (as instructed by the Users' Manual) before using this invention to avoid some of the Sabbath and Jewish Holiday prohibitions or interference with the performance of the features of the invention. These may include, for example, switching the oven light to continuously on, or removing the bulb, rather than being activated by an oven door switch; overriding the automatic oven shut-off after twelve hours; not selecting the convection fan feature of the oven since the fan would be temporarily switched off when the oven door was opened; disconnecting the continuously sounding signal at the completion of a timed bake. This latter function would not be necessary if the invention is utilized. Other functions of the stove may also have to be disabled so as not to violate the Orthodox Jewish laws of the Sabbath and Jewish Holidays.

Referring to FIG. 4, when the ignition circuit 30 is opened by the timer 14, when there is a selective deactivation, there is a simulated deactivation or fault in the ignition circuit 30, i.e., the glow bar igniter filament 24 is in open-circuit, therefore the igniter 24 will not heat up and no gas flame will be present because the gas supply/safety oven valve 22 closes or remains closed, the reason being that the circuit's proper resistance has not been achieved, therefore effectively turning off the gas oven 10 heater element 16. However, since power is maintained to the computer module of the oven 10 the predetermined temperature setting remains the same. Subsequently when the timer 14 closes the circuit 30 the simulated fault is removed and the igniter 24 heats igniting the heater element 16. The gas supply/safety valve 22 reopens, rekindling the oven 10, which will reach the preset temperature and the oven 10 will function normally until the next deactivation period is reached by the timer 14. If the oven 10 were an electric oven, the heating element will heat rather than an ignition of gas.

If a timing device or switch were to have been installed on the main power supply to the oven, rather than as indicated herein, a safety feature customarily incorporated by the manufacturers of ovens would reset (re-initialize) the computer controls and the oven 10 would not restart upon resumption of power to the oven 10 and produce the preset temperature. This incorporated safety feature is intended to prevent the oven 10 from restarting after recovery from a general power failure. This feature is not incorporated in older models, usually driven by electro-mechanical clocks, which makes them easier to control on the Sabbaths and Holidays, even when this invention is utilized.

If the cooking appliance is partially or completely powered by electricity, the invention will control electrical heating elements, e.g., in the oven, as well as any gas ignition devices. The invention may also include a timed switching device to activate and deactivate the heating element of a warming drawer, if the cooking appliance is so equipped.

A simple cooking appliance, built with limited or no timing capabilities, may have an additional count down timer wired in series with the one described to provide a timed-bake cooking feature with a simpler user initialization requirement. A programmable timer may be incorporated into the device to serve as an interrupter of the power supply to the gas electronic burner ignition cook (in an oven without a pilot light).

A timed switching device may be incorporated in the circuits of one or more of the electric burners 12, e.g., resistive, radiant or radio frequency coupled. This would allow a burner so enabled to turn ON and/or OFF at predetermined times, not necessarily at the onset of the Holiday, or OFF at a predetermined time on the Sabbath.

Referring to FIG. 4, an indicator lamp 26 may be installed in parallel with any one, or all, of the installed timers 14 or switches 18 to indicate when there is current supplied to the igniter 24, i.e., the circuit is closed by the timing device 14 or switch 18, or when in that state, whether the thermostat 28 is performing its function of completing its part of the circuit. This indication would inform the user when the oven door or warming drawer may be opened without causing a thermostat in an open state to be changed to a closed state because of the operator's action.

In the case of an electric igniter, burner or heating element the indication of a closed thermostat by the indicator lamp 26 would allow the user to vary the temperature within the confines of Orthodox Jewish Laws concerning Holiday cooking.

The control system of this invention can accommodate a wide range of voltages, including, but not limited to, the voltages commonly used in North and South America, Israel, Europe, Australia and South Africa.

It will be understood that various changes in the details, arrangements and configuration of the parts and assemblies which have been described and illustrated maybe made by those skilled in the art within the principle and scope of the present invention.

The invention claimed is:

1. A method for selectively and automatically activating a heater element of a cooking appliance to a predetermined level and subsequently automatically deactivating the heater element, such activating and deactivating occurring a plurality of times during at least one Jewish Holiday period of time in compliance with the Orthodox Jewish Laws, comprising:

a. providing a programmable timer in communication with the heater element of the cooking appliance which can be selectively programmed to provide for a plurality of cycles of an activation and a subsequent deactivation of the heater element in accordance with a predetermined schedule during a predetermined period of time that is longer than the at least one Jewish Holiday period of time, wherein when the programmable timer initially activates, the heater element activates in accordance with the predetermined schedule to a predetermined level determined by the cooking appliance, and wherein when the programmable timer subsequently deactivates, the heater element deactivates in accordance with the predetermined schedule, such activation and deactivation occurring for the scheduled cycle of activations and deactivations of the heater element;

b. wherein prior to the at least one Jewish Holiday period of time:

i. setting the predetermined level of the cooking appliance;

ii. programming the programmable timer to provide for the predetermined schedule of the plurality of cycles of activations and deactivations of the heater element during the at least one Jewish Holiday period of time;

iii. activating the programmable timer to activate the heater element to the predetermined level by the cooking appliance in accordance with the predetermined schedule;

whereby the heater element activates to the predetermined level and deactivates for a plurality of cycles in accordance with the predetermined schedule during the at least one Jewish Holiday period of time.

2. The method of claim 1, wherein the heater element is an electric heater element.

3. The method of claim 1, wherein the heater element is a gas heater element.

4. The method of claim 1, the cooking appliance is an oven and the heater element is an electric stove top heater element.

5. The method of claim 1, the cooking appliance is an oven and the heater element is an electric stove heater element.

6. The method of claim 1, the cooking appliance is an oven and the heater element is a gas burner stove top heater element.

7. The method of claim 1, the cooking appliance is an oven and the heater element is a gas burner stove heater element.

8. The method of claim 1, wherein the predetermined level of the cooking appliance is a temperature set with a thermostat.

9. The method of claim 1, wherein the programmable timer is selected form the group consisting of an electrical, electromechanical, electronic and digital programmable timer.

10. The method of claim 1, wherein there is a plurality of heater elements.

11. The method of claim 1, wherein there is a plurality of heater elements and a plurality of programmable timers, each timer in communication with a single heater element.

12. The method of claim 1, wherein there is a plurality of heater elements and a single programmable timer is in communication with the plurality of heater elements.

* * * * *